US007703453B2

(12) United States Patent
Hughes

(10) Patent No.: US 7,703,453 B2
(45) Date of Patent: Apr. 27, 2010

(54) SLIDE-OUT HALF RACK

(75) Inventor: James Hughes, Hendersonville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 143 days.

(21) Appl. No.: 11/466,584

(22) Filed: Aug. 23, 2006

(65) Prior Publication Data

US 2008/0047542 A1 Feb. 28, 2008

(51) Int. Cl.
*F24C 15/16* (2006.01)

(52) U.S. Cl. ..... 126/339; 123/332; 123/337 R; 123/337 A

(58) Field of Classification Search ..... 126/339, 126/332, 337 R, 337 A; 108/17, 59, 65, 91; 211/162, 126.1, 126.15, 126.3, 126.4; 312/273, 312/330.1, 308
See application file for complete search history.

(56) References Cited

U.S. PATENT DOCUMENTS 1,093,245 A * 4/1914 Best ..... 99/446
1,837,293 A * 12/1931 Sanford ..... 312/408
1,837,300 A * 12/1931 Stevenson ..... 108/181
1,872,733 A 8/1932 Greenwald
1,925,371 A * 9/1933 Charter ..... 211/153
1,997,432 A * 4/1935 Replogle ..... 211/153
2,002,339 A * 5/1935 Copeman ..... 62/381
2,006,385 A * 7/1935 Dikeman ..... 99/446
2,033,792 A * 3/1936 Sywert et al. ..... 211/153
2,033,859 A * 3/1936 Otte ..... 312/408
2,057,429 A * 10/1936 Heim ..... 211/153
2,065,116 A * 12/1936 Constantine et al. ..... 108/26
2,089,359 A * 8/1937 Goulooze ..... 108/26
2,095,811 A * 10/1937 Goulooze ..... 312/274
2,645,359 A * 7/1953 Jewell ..... 108/92
2,806,467 A * 9/1957 Slaughter ..... 126/337 R
3,012,554 A 12/1961 Hirsch
3,266,484 A 8/1966 Carpenter et al.
3,450,025 A 6/1969 Fleming
3,550,580 A * 12/1970 Wong ..... 126/337 R
D291,646 S * 9/1987 Koziol ..... D7/409
5,788,094 A * 8/1998 Kim et al. ..... 211/153
D426,749 S 6/2000 Barnes et al.
6,112,916 A 9/2000 Barnes et al.
6,148,813 A * 11/2000 Barnes et al. ..... 126/339
6,349,717 B1 2/2002 Thompson et al.
6,644,302 B1 11/2003 Bartley
6,663,204 B2 * 12/2003 Atalla et al. ..... 312/408
6,926,001 B2 * 8/2005 Bartley ..... 126/337 R
D509,405 S * 9/2005 Shin ..... D7/409
7,347,198 B2 * 3/2008 Freese et al. ..... 126/337 R (Continued)

*Primary Examiner*—Kenneth B Rinehart
*Assistant Examiner*—Jorge Pereiro
(74) *Attorney, Agent, or Firm*—Pearne & Gordon LLP

(57) ABSTRACT

The rack includes a main section including a primary platform area and a secondary platform area. The primary platform area includes a plurality of elongated support bars and at least one cross member provided across a portion of the primary platform area to provide strength. An auxiliary section has an auxiliary platform area and is adapted to be slidably received by the main section to move between a retracted position and an extended position. The auxiliary platform is adapted to support various items independent of whether it is in retracted position or the extended position. In one example, the auxiliary section is adapted to be slidably received in a recessed area. In addition or alternatively, the auxiliary section is adapted to be removable from the main section.

19 Claims, 6 Drawing Sheets

U.S. PATENT DOCUMENTS 6,205,997 B1 3/2009 Bartley
2004/0094143 A1 5/2004 Bartley
2004/0112371 A1 6/2004 Le et al.
2005/0218096 A1* 10/2005 Dunn ..... 211/153

* cited by examiner

SLIDE-OUT HALF RACK

RELATED APPLICATIONS

Not Applicable.

BACKGROUND OF THE INVENTION

1) Field of the Invention

The present invention relates to racks for appliances, and more particularly, to a slide-out half rack for an oven.

2) Description of Prior Art

Ovens often have one or more racks generally within the oven. The racks are useful for the placing of cookware, food, and other items, within the oven. The racks place the cookware generally towards the middle of the oven, and keep the cookware away from heating elements and the like. In addition, ovens with multiple racks allow for placement of cookware on a variety of levels within the oven, thereby increasing the total volume of available cooking space.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Oven racks are often of wire form construction. More specifically, an outer wire frame and a support platform, which is constituted by a plurality of fore-to-aft and laterally spaced wires, define a typical oven rack. The wires are substantially evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a slide-out half rack for an appliance is provided. The rack includes a main section including a primary platform area and a secondary platform area. The primary platform area includes a plurality of elongated support bars and at least one cross member provided across a portion of the primary platform area to provide strength. An auxiliary section has an auxiliary platform area and is adapted to be slidably received by the main section to move between a retracted position and an extended position. The auxiliary platform is adapted to support various items independent of whether it is in retracted position or the extended position.

In accordance with another aspect of the present invention, a slide-out half rack is provided. The rack includes a main section having a primary platform area extending along a first plane and a secondary platform area extending along a second plane. The second plane is located below the first plane to form a recessed area. An auxiliary section has an auxiliary platform area and is adapted to be slidably received by the recessed area. The auxiliary section is adapted to be removable from the main section.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
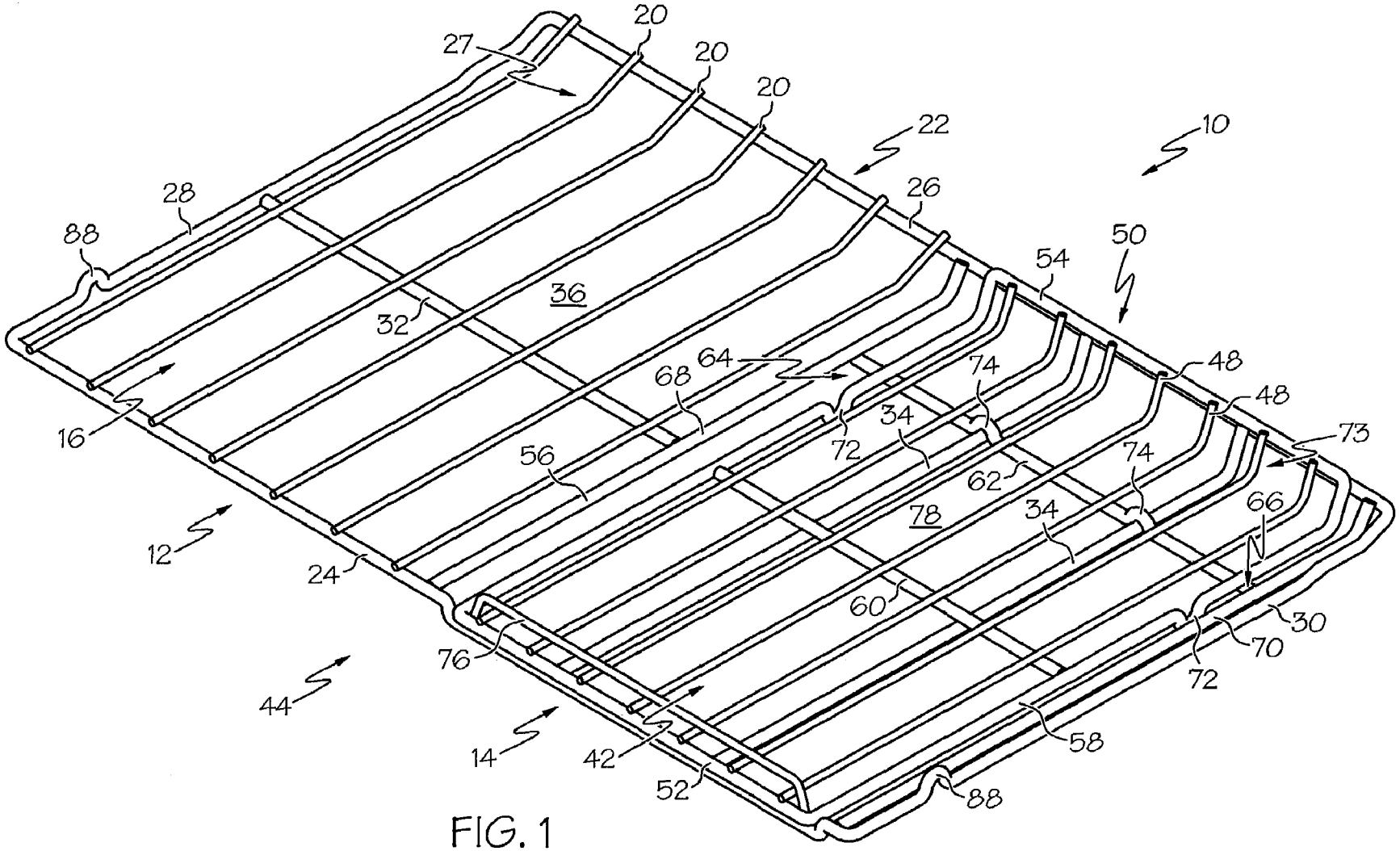
FIG. 1 illustrates a perspective view of an example of a slide-out half rack having a main section and an auxiliary section in accordance with an aspect of the present invention.

The present invention relates to a slide-out half rack for an oven. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention may be practiced without these specific details.

Figure 2:
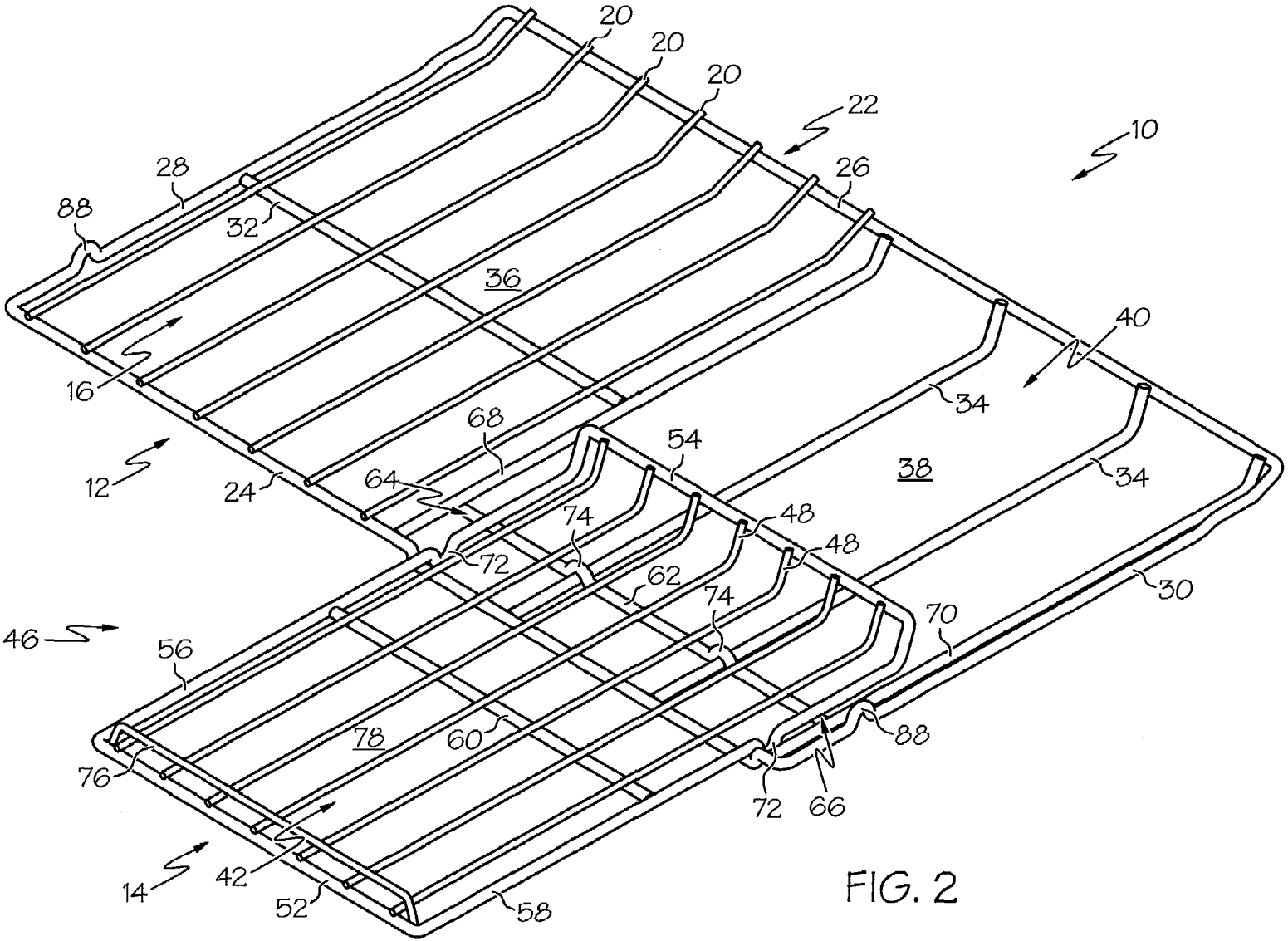
FIG. 2 illustrates a perspective view of the example slide-out half rack of FIG. 1 in accordance with another aspect of the present invention.

Referring initially to FIG. 1, an example of a rack 10 for an appliance, such as an oven, refrigerator, or freezer is illustrated in accordance with an aspect of the present invention. The rack 10 includes a main section 12 and an auxiliary section 14. As shown, the auxiliary section 14 can be relatively smaller than the main section 12 (e.g., occupying a partial area of the rack 10). Both the main section 12 and the auxiliary section 14 can be constructed from metal wire, such as iron coated with nickel or steel coated with porcelain. However, it is to be appreciated that either, or both of the main section 12 and the auxiliary section 14 can be constructed from various other suitable materials (e.g., aluminum, sheet metal, or the like). Moreover, it is to be appreciated that the main section 12 can be constructed from a first material and the auxiliary section 14 can be constructed from a second different material. The auxiliary section 14 is adapted to be slidably received by the main section 12, as shown in FIG. 2 and as will be discussed more fully herein.

Figure 3:
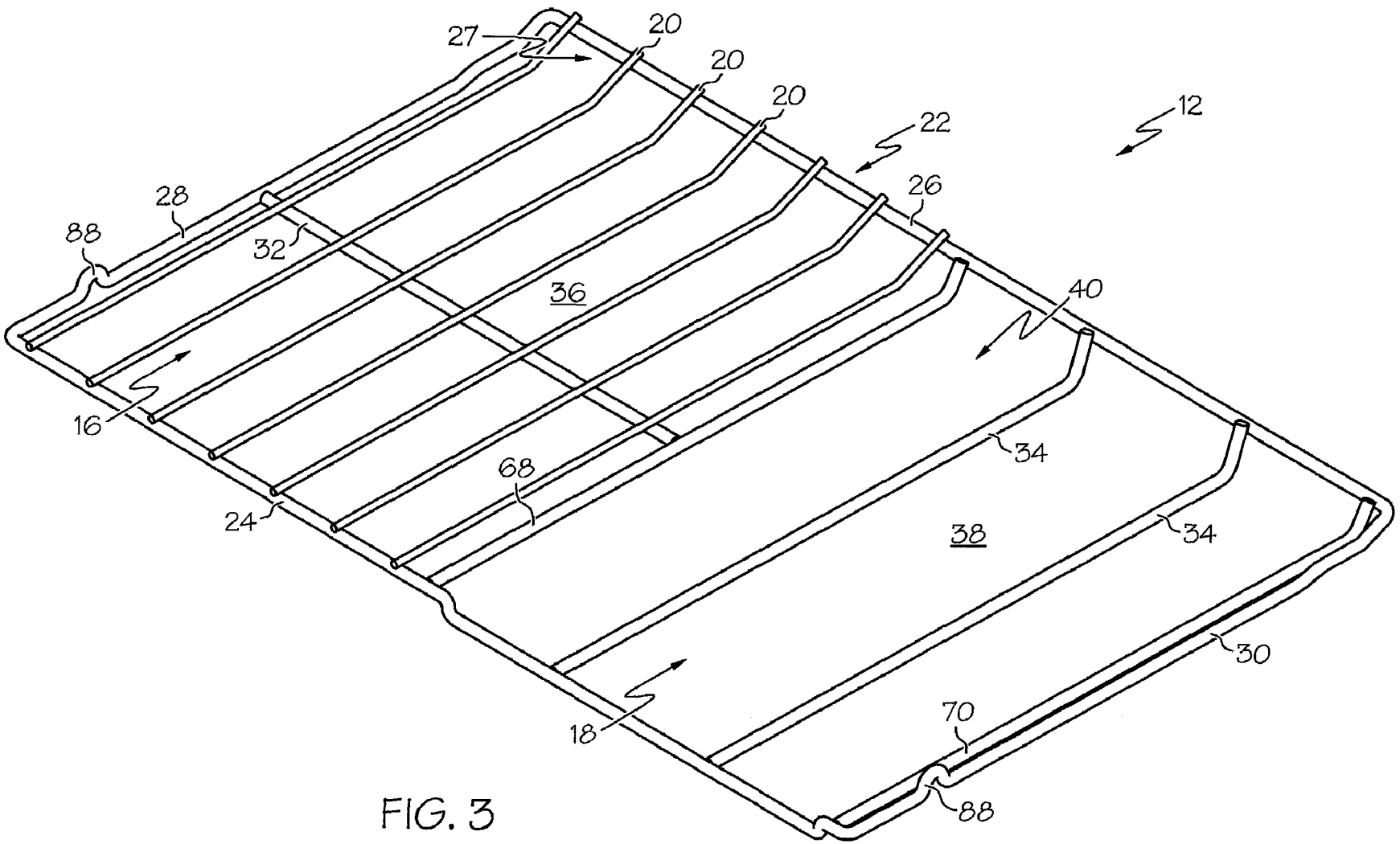
FIG. 3 illustrates a perspective view of the main section of the slide-out half rack of FIG. 1 in accordance with an aspect of the present invention.

Turning now to the example shown in FIG. 3, the main section 12 can include a primary platform area 16 and a secondary platform area 18. The rack 10 can include a support frame 22, and a plurality of elongated support bars 20 can extend across the support frame 22 to form the primary platform area 16. As shown, the frame can include a front bar 24, rear bar 26, and apposed side bars 28, 30 that can be attached together to form the support frame 22 in various manners, such as by welding, adhesives, or fasteners, and/or can even be formed from a single piece of wire. The elongated support bars 20 can extend between the front bar 24 and the rear bar 26, though it is to be appreciated that the support bars 20 can also be oriented in various manners.

As shown, the support frame 22 can have a generally rectangular geometry, through it is to be appreciated that the support frame 22 can also have various other geometries. Additionally, as shown, the rear bar 26 of the support frame 22 can be located at a relatively higher position with respect to the front bar 24. Thus, a portion of the support members 20 attached to the rear bar 26 can act as a stop 27 to limit the extent to which an item can be inserted into an oven cavity. In addition or alternatively, the main section 12 can include an additional platform area (not shown) located adjacent the rear bar 26 to provide support for even larger items.

Additionally, the rack 10 can include at least one cross member 32 or strengthening member provided across a portion of the primary platform 16 area to provide strength. The cross member(s) 32 operate to mitigate sagging of the primary platform area 16 with respect to the front bar 24 when heavy food, cookware, or the like (not shown) is placed on the primary platform area 16. Sagging of the primary platform area 16 presents problems with easily sliding the food or cookware from the primary platform area 16 without interference from the front bar 24. The ends of the support members 20 and/or the cross member 32 can be welded (e.g., spot welded), otherwise secured to, or even formed together as a single unit with, the various portions of the rack 10. Further, the support members 20, frame 22, and/or cross member 32 can be manufactured from metal wire or any other suitable material which provides adequate strength to support items such as cake pans, pizza stones and casseroles, or the like, and withstands the heat of an oven. It is to be appreciated that the cross members 32 can be oriented in various other manners, including transverse or angled relative to the elongated support members 20.

Further, the secondary platform area 18 can include at least one elongated support member 34, and can also include one or more cross members (not shown). Thus, as shown, the support members 20 of the primary platform area 16 can extend substantially parallel to each other such that the primary platform area 16 substantially extends along a first plane 36. Similarly, the support members 34 of the secondary platform area 18 can extend substantially parallel to each other such that the second platform area 18 extends along a second plane 38. Further, the second plane 38 can be located below the first plane 36 to form a recessed area 40, as will be discussed more fully herein.

Figure 4:
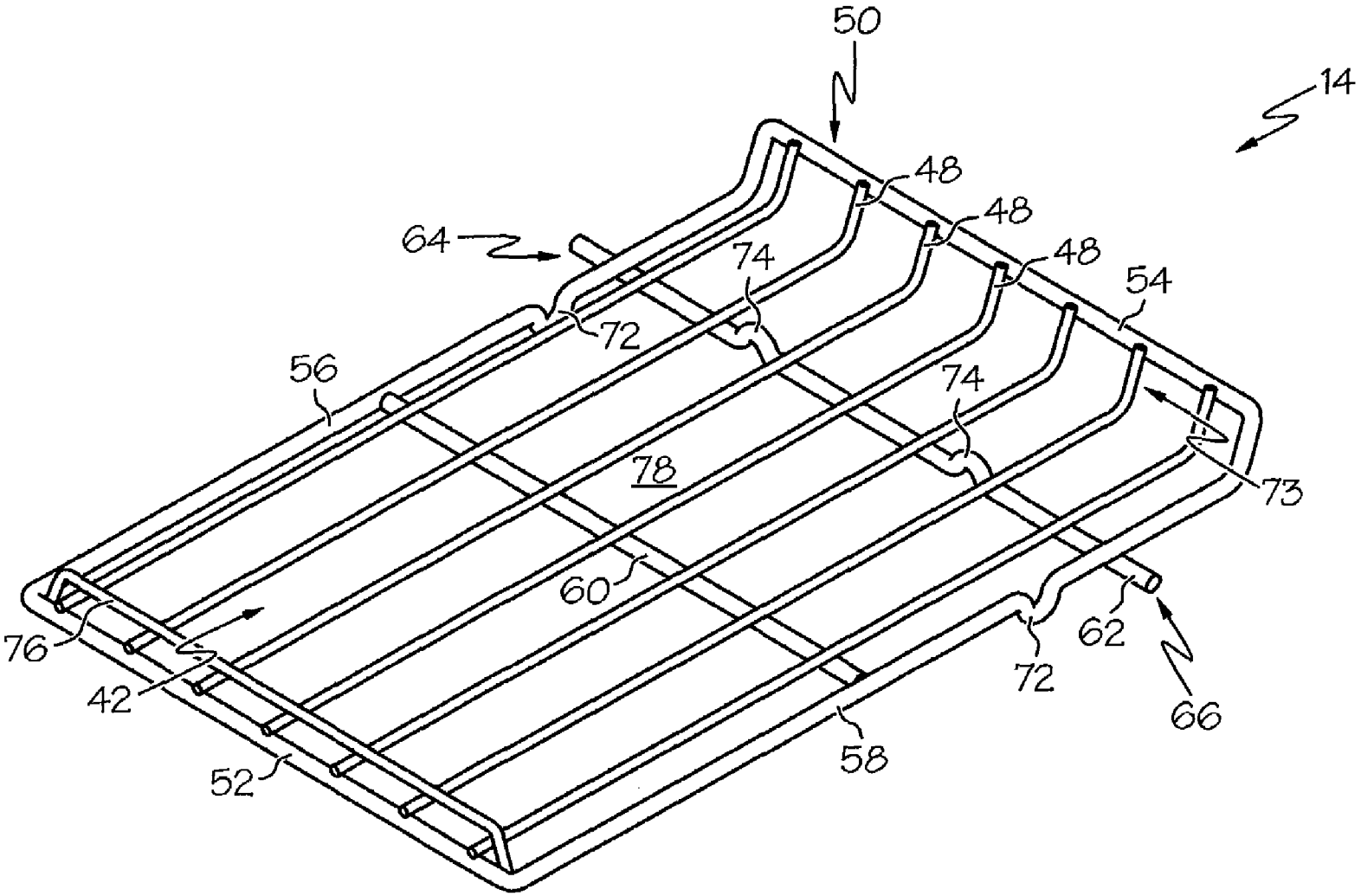
FIG. 4 illustrates a perspective view of the auxiliary section of the slide-out half rack of FIG. 1 in accordance with an aspect of the present invention.

Turning now to the example of FIG. 4, the rack 10 also includes an auxiliary section 14 having an auxiliary platform area 42. The auxiliary section 14 can be adapted to be slidably received by the main section 12 to be moved between a retracted position 44, as shown in FIG. 1, and an extended position 46, as shown in FIG. 2. The auxiliary section 14 is adapted to support various items, such as cookware, food, and other items, within the oven. Further, the auxiliary section 14 can be adapted to support various items independent of whether it is in the retracted position 44 or the extended position 46. For example, in the retracted position 44, the auxiliary section 14 can be adapted to support various items, such as a large cookie sheet, in conjunction with the primary platform area 16, though it is to be appreciated that the auxiliary section 14 can also support the item independently. In another example, when in the extended position 46, or when in the transition between the retracted and extended positions 44, 46, the auxiliary section 14 can also be adapted to independently support various items. In yet another example, the main section 12 of the rack 10 can be adapted to move between a retracted and an extended position (not shown) relative to the oven cavity 84 (see FIG. 5), and the auxiliary section 14 can be further adapted to independently support various items regardless of the positioning of the main section 12. Thus, the auxiliary section 14 can be adapted to support various items when it is in a "double extended" position (i.e., the main section 12 is extended from the oven cavity 84, and the auxiliary section 14 is further extended away from the main section 12).

The auxiliary platform area 42 can also include a plurality of elongated support bars 48. For example, the auxiliary platform area 42 can include a support frame 50, and the elongated support bars 48 can extend across the support frame 50. As shown, the frame 50 can include a front bar 52, rear bar 54, and apposed side bars 56, 58, and the elongated support bars 48 can extend between the front bar 52 and the rear bar 54, though it is to be appreciated that the support bars 48 can be oriented in various other manners. In addition or alternatively, the auxiliary section 14 can be configured to include various geometries, such as, for example, square, rectangular, triangular, polygonal, circular, oval and/or elliptical, and the rack 10 can even include a plurality of auxiliary sections 14 (not shown).

Additionally, the auxiliary section 14 can include at least one cross member 60 or strengthening member provided across a portion of the auxiliary platform 42 area to provide strength. As with the main section 12, the cross member(s) 60 operate to mitigate sagging of the auxiliary platform area 42 with respect to the front bar 52 when heavy food, cookware, or the like is placed on the auxiliary platform area 60. The ends of the support members 48 and/or the cross member 60 can be welded (e.g., spot welded), otherwise secured to, or even formed together as a single unit with, the various portions of the auxiliary section 14. Further, the support members 48, frame 50, and/or cross member 60 can be manufactured from metal wire or any other suitable material which provides adequate strength to support items such as cake pans, pizza stones and casseroles, or the like, and withstands the heat of an oven.

As stated previously, the auxiliary section 14 can be adapted to slidably move relative to the main section 12 between a retracted position 44 and an extended position 46. In addition or alternatively, the auxiliary section 14 can be adapted to telescope relative to the main section 12. Thus, as shown in FIG. 2, the auxiliary section 14 can be adapted to move in an overlapping fashion relative to the secondary platform area 18.

The auxiliary section 14 can comprise various structures to enable it to slidingly and/or telescopically move relative to the main section 12. In one example, the auxiliary section 14 can include an outwardly extending support bar 62 having at least one end 64 configured for sliding engagement with the main section 12. As shown in FIG. 4, the outwardly extending support bar 62 can include two outwardly extending ends 64, 66. The ends 64, 66 of the outwardly extending support bar 62 can each extend a distance away from the side bars 56, 58, respectively. It is to be appreciated that the outwardly extending support bar 62 can be disposed in various locations on the auxiliary section 14, and can also extend across a portion of the auxiliary support platform 42 and to as a strengthening support similar to the cross member 60.

Correspondingly, the main section 12 can also include at least one support wire 68 configured to define a horizontal travel path relative to the main section 12 for the end(s) 64, 66 of the outwardly extending support bar 62. As shown in FIGS. 2-3, the main section 12 can include a pair of support wires 68, 70 configured to define the horizontal travel path. It is to be appreciated that the term horizontal refers to a direction perpendicular to the longitudinal extent of the rack 10, such that a user could slide the auxiliary rack 14 into and out of an appliance, such as into and out of an oven cavity 84 (see FIG. 5).

Turning back to the example shown in FIG. 2, the ends 64, 66 of the outwardly extending support bar 62 can be adapted to slide along the support wires 68, 70. As shown, the ends 64, 66 can be adapted to slide beneath the support wires 68, 70, though it is to be appreciated that the ends 64, 66 could also be adapted to slide above, or even in between, various configurations of support wires. Further, the auxiliary section 14 can slide relative to the main section 12 using various other methods. For example, the rack 10 could include known telescoping support slides (e.g., telescoping ball bearing support slides, or the like), a wheeled transport mechanism, or a sliding tongue and groove system, though various other methods could also be used.

Returning now to FIG. 4, the auxiliary section 14 can also include various other features. For example, the auxiliary section 14 can include at least one stop member 72 adapted to inhibit sliding motion of the auxiliary section 14. As shown in FIG. 2, for example, the auxiliary section 14 can include a pair of stop members 72 that are adapted to abut the front bar 24 of the support frame 22 of the main section 12 when the auxiliary section 14 is in the fully extended position 46. In addition or alternatively, the elongated support members 48 of the auxiliary section can be configured to form a rear stop portion 73 configured to abut the rear bar 26 of the main support frame 22 when the auxiliary section 14 is in the fully retracted position 44. It is to be appreciated that the stop members 72 can cooperate with the ends 64, 66 and the support wires 68, 70 to prevent tipping of the auxiliary section 14 when it is in the extended position 46. Various other stop and/or anti-tipping mechanisms are also contemplated to be within the scope of this disclosure.

In another example, the auxiliary platform can include at least one guide member 74 adapted to engage a portion of the secondary platform area 18. As shown in FIG. 2, the outwardly extending support bar 62 of the auxiliary section 14 can include a pair of guide members 74. The guide members can comprise a rounded geometry adapted to slide upon the elongated support members 34 of the secondary platform area 18, though other guide members are also contemplated.

In yet another example, the auxiliary platform 14 can include a handle portion 76 adapted to facilitate movement of the auxiliary platform from the retracted position 44 to the extended position 46. As shown, the handle 76 can be formed of a similar material as the main rack 12 (e.g., metal wire or the like) and can be attached to (e.g., welding or the like), or formed with, the front bar 52 of the auxiliary section 14. In addition or alternatively, the handle 76 can also be disposed at various other locations, and can even be formed as part of the front bar 52. The handle 76 can be configured to be grasped to a hand of a user, and can include various coatings and/or a covering member (e.g., silicone, porcelain, ceramic, or the like) adapted to insulate a user's hand from the heat of an oven. In addition or alternatively, the main section 12 can also include a handle (not shown) to facilitate movement of the rack 10 relative to the oven cavity 84. It is to be appreciated that the various additional features discussed herein are not intended to provide any limitation upon the present invention, and that modification of the features and or the addition of other features are contemplated to be within the scope of the invention.

As stated previously, the rack 10 can include a recessed area 40 formed by the secondary platform area 18. As shown in FIG. 2, the auxiliary section 14 can be slidably received by the recessed area 40. Thus, the auxiliary section 14 can be configured to move (e.g., slide, move in a linear path, and/or telescope) within the recessed area 40 between the retracted and extended positions 44, 46. In addition or alternatively, the recessed area 40 can be configured to include various geometries, such as, for example, square, triangular, polygonal, circular, oval and/or elliptical that correspond to the geometry of the auxiliary section 14. It is to be appreciated that the recessed area 40 can also be configured to receive a plurality of auxiliary sections 14, and/or the rack 10 can even include a plurality of recessed areas 40 (not shown).

In addition, when the auxiliary section 14 is in the retracted position 44, the auxiliary platform area 42 can extend along a third plane 78 that is substantially co-planar to the first plane 36 of the primary platform area 16. Thus, as shown in FIG. 1, the third plane 78 can be substantially co-planar with the first plane 36 such that the primary platform area 16 and the auxiliary platform area 42 can cooperate to support various foods or cookware within an appliance, such as in an oven cavity. For example, the primary and auxiliary platform areas 16, 42 can cooperate to support a large cookie sheet or casserole dish (not shown). Further, when the platform areas 16, 42 are substantially co-planar, various items can be easily moved (e.g., slid) therebetween to facilitate removal from the oven cavity. It is to be appreciated that the third plane 78 can also be oriented at various other heights relative to the first and/or second planes 36, 38.

Further still, the auxiliary section 14 can be adapted to be removable from the main section 12. For example, the auxiliary section 14 can be completely removed from the main section 12 such that the main section can remain within an oven while the auxiliary section 14 is removed therefrom. For example, when the auxiliary section 14 is removed from the main section 12, it can be stored or used as a cooling rack for supporting hot items or baked goods on a counter top. Thus, the auxiliary section 14 can include a plurality of support legs and/or support feet (not shown) or the like to support the auxiliary section 14 about a counter if it is employed as a cooling rack. Since the auxiliary section 14 is relatively small and light, its removal from the main rack can be readily accomplished with little effort. In one example, the auxiliary section 14 can be removed from the main section 12 by orienting it at an angle relative to the main section 12 to release one of the ends 64, 66 of the outwardly extending support bar 62 from one of the support wires 68, 70 of the main section 12 to thereby disengage the auxiliary section 14 from the main section 12, though other methods of removal are also contemplated.

In addition or alternatively, the primary platform area 16 and the secondary platform area 18 can each be adapted to support various items (e.g., food to be cooked, cookware, or the like) independent of whether the auxiliary section 14 is removed from the main section 12. Thus, the primary platform section 16 can support various items regardless of whether the auxiliary section 14 is in the retracted or extended positions 44, 46, or is completely removed from the main section 12. Further, when the auxiliary section 14 is removed from the main section 12, the secondary platform area 18 can be adapted to support various items within an oven. For example, because the secondary platform area 18 includes the recessed area 40, relatively taller items can be placed on the secondary platform area 18 (e.g., items that might be too tall to be supported by the primary platform area 16). As such, the secondary platform area 18 can include various strengthening members, such as larger support members 34 and/or the addition of cross members (not shown) or the like provided across a portion thereof.

Figure 5:
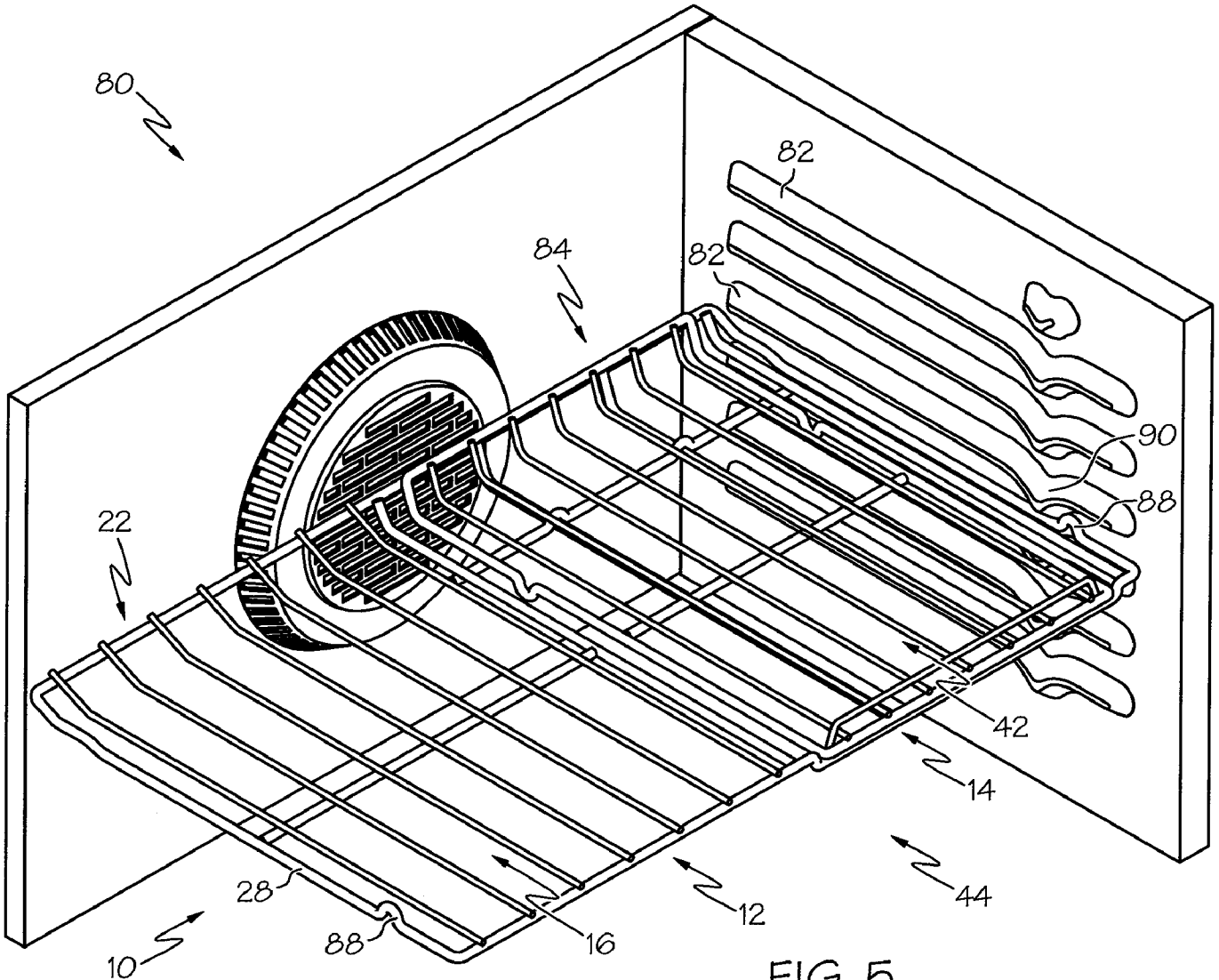
FIG. 5 illustrates a perspective view of the slide-out half rack in an oven environment with the auxiliary section in a retracted position.
Figure 6:
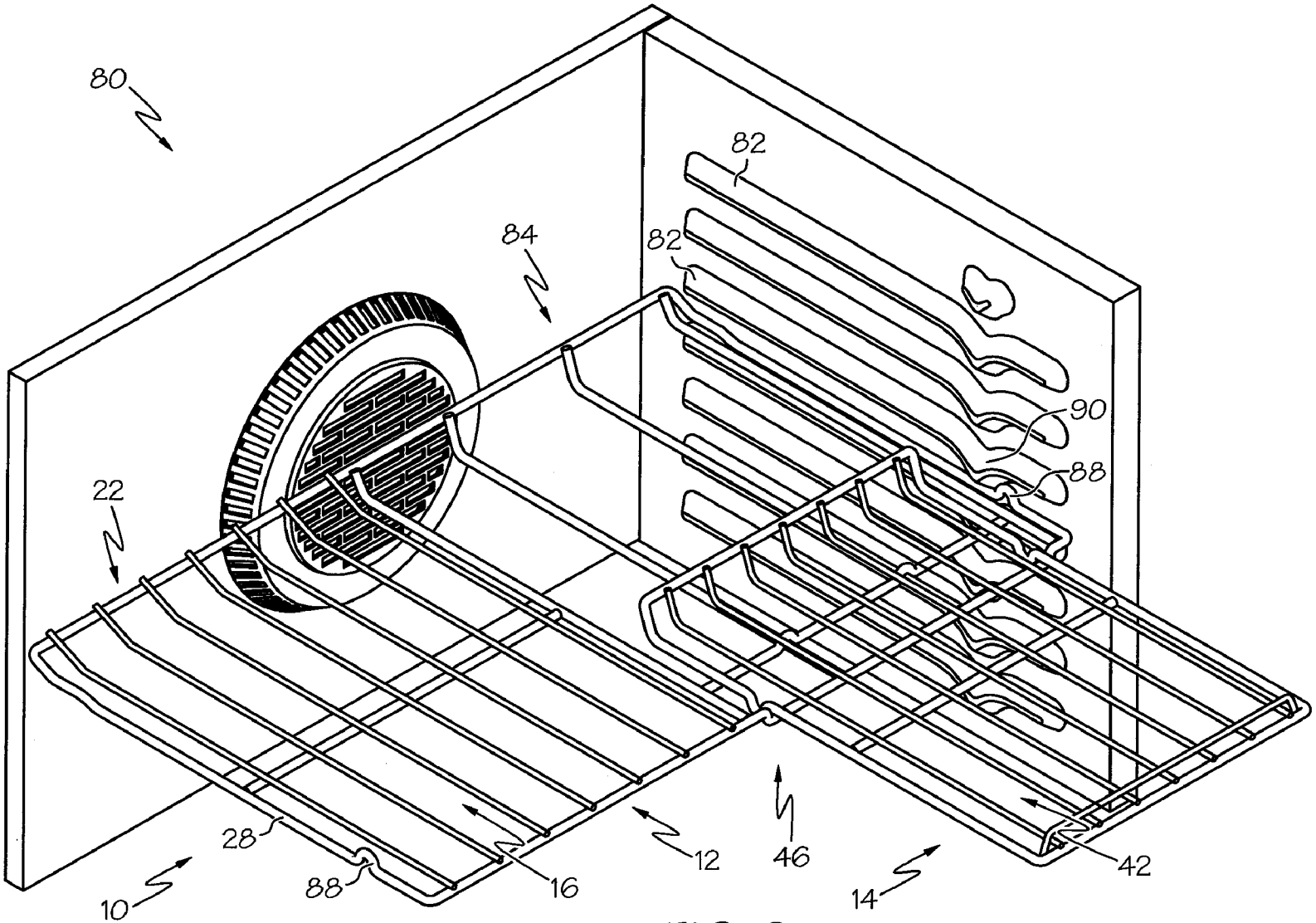
FIG. 6 is similar to FIG. 5, but shows the auxiliary section in an extended position.

Turning now to FIGS. 5-6, the rack 10 of the present invention is illustrated employed within an oven environment 80. Thus, as shown, the support frame 22 of the main section 12 can be supported by guide rails 82 within an oven cavity 84. As shown in FIG. 1, the main section 12 can include an upward-facing projection 88 integrally formed in the wire frame of each of the sides 28, 30 of the support frame 22 to facilitate alignment of the rack 10 within the oven 80. As shown, the guide rails 82 of the oven 80 can have corresponding downward-facing projections 90. Specifically, the upward-facing projections 88 of the main section 12 can be adapted to contact the downward-facing projections 90 of the top guide rails 82 such that a stop is created to properly align the main section 12 within the standard rack location of the oven 80.

Accordingly, with the rack 10 supported within the oven cavity 84, the primary platform area 16 of the main section 12 and the auxiliary platform area 42 of the auxiliary section 14 can be utilized to support various items for cooking within the oven. As shown in FIG. 5, the rack 10 can be supported with in the oven cavity 84 in the retracted position 44. Alternatively, as shown in FIG. 6, the rack 10 can also be similarly supported in the extended position 46. Thus, for example, various items could be easily retrieved from the auxiliary section 14 without having to extend the main section 12. It is to be appreciated that the auxiliary section 14 can be in the fully extended position 46 even when the rack 10 is also fully extended (not shown). In addition or alternatively, various items can also be supported on other oven racks (not shown) simultaneously without the need to add or remove any other racks.

It is to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the example embodiments, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A rack for an appliance comprising;

a main section including a primary platform area defining a first plane and a secondary platform area defining a second plane, wherein the primary platform area includes a plurality of elongated support bars, and wherein the second plane is located below the first plane; and an auxiliary section having an auxiliary platform area and adapted to be slidably received on the secondary platform area to move between a retracted position and an extended position, wherein the auxiliary platform is adapted to support various items independent of whether it is in the retracted position or the extended position, wherein the extended position of the auxiliary platform area extends beyond a frontmost crossbar of the main section, wherein the auxiliary section includes a transversely-extending support bar having two ends, each end extending transversely a distance away from the auxiliary section along a sliding plane generally parallel to the primary platform area, and wherein the main section includes a pair of support wires configured to define a horizontal travel path relative to the main section for the ends of the support bar, and wherein each of the ends of the support bar are disposed below the support wires and are adapted for sliding engagement along an underside of the support wires.

2. The rack of claim 1, wherein the auxiliary section is adapted to be removable from the main section.

3. The rack of claim 2, wherein the primary platform area and the secondary platform area are each adapted to support various items independent of whether the auxiliary section is removed from the main section.

4. The rack of claim 1, wherein the auxiliary section is adapted to telescope relative to the main section.

5. The rack of claim 1, further comprising a handle portion disposed on the auxiliary section.

6. The rack of claim 1, wherein the auxiliary section includes at least one stop member adapted to inhibit sliding motion of the auxiliary section.

7. The rack of claim 1, wherein the auxiliary platform area is substantially coplanar to the primary platform area when the auxiliary section is in the retracted position.

8. The rack of claim 1, wherein the support bar of the auxiliary section includes at least one upwardly-extending guide member adapted to slidingly engage an elongated support bar of the secondary platform area.

9. The rack of claim 8, wherein the upwardly-extending guide member includes a rounded geometry adapted to receive corresponding geometry of the elongated support bar of the secondary platform area.

10. The rack of claim 1, wherein the transversely extending ends of the support bar are adapted to inhibit tipping of the auxiliary section when it is in the extended position.

11. A rack for an appliance comprising;

a main section defining a width and including a primary platform area extending along a first plane and a secondary platform area extending along a second plane, the first plane being substantially parallel to the second plane, wherein the second plane is located below the first plane to form a recessed area, and wherein the first plane is transversely offset from the second plane such that a sum of the primary platform width and the secondary platform width is substantially equivalent to the width of the main section; and an auxiliary section having an auxiliary platform area and adapted to be slidably received on the secondary platform area, wherein the auxiliary section is adapted to be removable from the main section, wherein the auxiliary platform area extends along a third plane that is substantially co-planar to the first plane, and wherein a sum of the primary platform width and the auxiliary platform width is substantially equivalent to the width of the main section, wherein the auxiliary section includes a support bar positioned in a rear half of the auxiliary section, the support bar having two ends, each end extending a distance away from the auxiliary section and configured for sliding engagement with the main section.

12. The rack of claim 11, wherein the auxiliary section is configured to move within the recessed area between a retracted position and an extended position.

13. The rack of claim 12, wherein the auxiliary platform area further includes an upwardly-extending rear stop portion adapted to abut a portion of the main section when the auxiliary section is in the retracted position.

14. The rack of claim 12, wherein the auxiliary platform is adapted to support various items independent of whether it is in the retracted position or the extended position.

15. The rack of claim 12, wherein the primary platform area and the secondary platform area are each adapted to support various items independent of whether the auxiliary section is removed from the main section.

16. The rack of claim 11, wherein the auxiliary section is adapted to telescope relative to the main section.

17. The rack of claim 11, further comprising a handle portion disposed on the auxiliary section, wherein at least a portion of the handle extends generally upwards relative to the third plane.

18. The rack of claim 11, wherein the main section includes a pair of support wires configured to define a horizontal travel path relative to the main section for the ends of the support bar, and wherein each of the ends of the support bar are disposed below the support wires and are adapted for sliding engagement along an underside of the support wires.

19. A rack for an oven comprising;

a main section including a frame including first and second side edges adapted to engage respective guide rails located in an oven cavity to support the rack within the oven cavity, at least one of the side edges including a projection for engagement with a corresponding projection of one of the guide rails to inhibit movement of the rack relative to the oven cavity, the main section further including a primary platform area extending along a first plane and a secondary platform area extending along a second plane, the first plane being substantially parallel to the second plane, wherein the second plane is located below the first plane to form a recessed area, and wherein the first plane is transversely offset from the second plane; and an auxiliary section having an auxiliary platform area and adapted to telescope relative to the main section within the recessed area, wherein the auxiliary section is adapted to be removable from the main section, wherein the auxiliary platform area extends along a third plane that is substantially co-planar to the first plane, and wherein the auxiliary platform area further includes an upwardly-extending rear stop portion, and wherein the auxiliary section further includes at least one downwardly extending stop member configured to abut a portion of the main section.

* * * * *